United States Patent [19]

Koike

[11] Patent Number: 5,017,027

[45] Date of Patent: May 21, 1991

[54] IMPACT PRINTER

[75] Inventor: Kiyofumi Koike, Nagano, Japan

[73] Assignee: Seiko Epson Corporation, Tokyo, Japan

[21] Appl. No.: 394,452

[22] Filed: Aug. 16, 1989

[30] Foreign Application Priority Data

Aug. 22, 1988 [JP] Japan ..... 63-207679

[51] Int. Cl.[5] ..... B41J 11/08

[52] U.S. Cl. ..... 400/54; 400/58; 400/124

[58] Field of Search ..... 400/54–59, 400/124 TC

[56] References Cited

U.S. PATENT DOCUMENTS

| | | | |
|---|---|---|---|
| 4,579,467 | 4/1986 | Furukawa | 400/54 |
| 4,705,412 | 11/1987 | Matsumoto | 400/54 |
| 4,706,561 | 11/1987 | Greer | 400/54 |

FOREIGN PATENT DOCUMENTS

| | | | |
|---|---|---|---|
| 84987 | 7/1981 | Japan | 400/124 |
| 197178 | 12/1982 | Japan | 400/124 |
| 29169 | 2/1984 | Japan | 400/54 |
| 122772 | 6/1987 | Japan | 400/55 |
| 187063 | 8/1987 | Japan | 400/59 |
| 263068 | 11/1987 | Japan | 400/124 |
| 264965 | 11/1987 | Japan | 400/157.2 |

*Primary Examiner*—David A. Wiecking
*Assistant Examiner*—Steven S. Kelley
*Attorney, Agent, or Firm*—Blum Kaplan

[57] ABSTRACT

An impact printer having a platen, an impact printing member such as a printing wire, a driver such as a driving coil for driving the impact member, a controller for controlling the driver and a temperature detector. Before printing data is printed, the temperature detector compares the temperature of the printer to a set point. If the temperature is too low, a warm-up signal is provided and the driver displaces the printing member to such an extent that printing does not occur. The warm-up signal can also cause the gap between the platen and the printing member to widen to such an extent that printing cannot occur.

20 Claims, 3 Drawing Sheets

IMPACT PRINTER

BACKGROUND OF THE INVENTION

This invention relates generally to an impact printer and, in particular, to an impact printer in which printing is affected by striking the tips of printing wires against an ink ribbon.

Conventional impact printers commonly include printing wires disposed in wire guides and driven by electric coils, for impacting an ink ribbon against recording paper. These printers have drawbacks because ink from the ink ribbon enters a gap existing between the printing wires and the wire guides. This ink interferes with the motion of the printing wires which can result in omitted dots or uneven printing darkness.

A lubricant is commonly included in the print head of conventional impact printers to improve the durability of the elements within the head. However, the lubricant can hinder the movement of the printing wires or levers that drive the printing wires. This also results in omitted ink dots and uneven printing darkness.

To overcome these problems, conventional printers commonly include a warm-up operation before printing begins. The warm-up is typically controlled by a combination of (1) a timer which outputs a warm-up signal when it detects that a printing signal has not been received for a predetermined period of time and (2) a pulse generator responsive to the warm-up signal for driving the printing wires, but to a small extent so that printing does not occur. This warm-up operation is also described in Japanese Post-Examination Publication Number 58-45351 (1983).

This prior art warm-up method suffers from the following drawbacks. The warm-up process only occurs when it is detected that printing was not carried out for a predetermined period of time. However, it does not take the temperature of the ink and lubricant into consideration. Temperature has a substantial effect on the ability of ink from the ink ribbon and the lubricant to interfere with movement of the printing wires and the levers driving the printing wires. Accordingly, unnecessary warming-up is frequently carried out which decreases the throughput of the printer.

Other conventional warm-up methods that depend on temperature have drawbacks. If the warm-up printing wire driving conditions are set so that warming-up occurs when the temperature is low and the wires move without causing printing to occur, the output of the force of the printing wires typically becomes too strong when the temperature is ordinary or high. This can result in staining the printing paper. If warming-up driving conditions are set so that the printing paper will not be stained, the effectiveness of the warming-up operations is diminished at low temperatures.

Conventional impact printers therefore have inadequacies due to these shortcomings. Accordingly, it is desirable to provide an impact printer which avoids the shortcomings of the prior art and prints clear uniform characters without skipping data, improperly varying the print darkness or staining the paper as well as avoiding excessive down time.

SUMMARY OF THE INVENTION

Generally speaking, in accordance with the present invention, an impact printer for transferring printing material from a transfer medium to a recording medium that includes an impact printing member, a driving mechanism for driving the printing member, a controller for controlling the driving mechanism and a temperature detector is provided in which, during a warm-up period, the driving mechanism is energized to such an extent that the impact printing member moves but printing does not occur. The printer can also include a device for widening the gap between a platen for holding recording paper and the impact printing members during the warm-up operation so that printing cannot occur. In a preferred embodiment of the impact printer, the printing members are printing wires and the driving mechanism is a coil. The warm-up procedure is conducted when the temperature detector detects a temperature below a specified value such as about 10° C. so that the viscosities of trapped printing ink or a lubricant that would interfere with movement of the print wires can be lowered or the interfering material can be scattered.

Accordingly, it is an object of the present invention to provide an impact printer with an improved warm-up operation.

Another object of the invention is to provide an impact printer in which the movement of impact members are not impeded by interfering ink or lubricant.

A further object of the invention is to provide an impact printer which will provide print that does not contain missing dots, uneven print darkness or paper stains.

Still another object of the invention is to provide an impact printer having high throughput.

Still a further object of the invention is to provide an improved temperature controlled warm-up mechanism for an impact printer.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangements of parts which are adapted to affect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
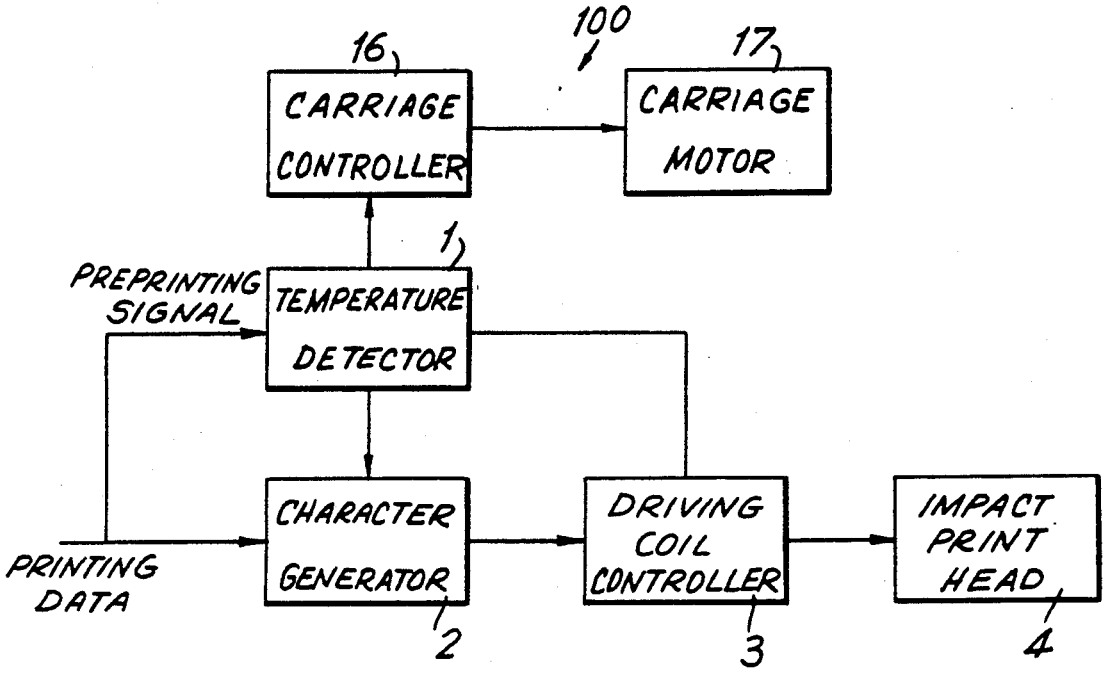
FIG. 1 is a block diagram showing functional portions of a printer constructed in accordance with an embodiment of the present invention.
Figure 2:
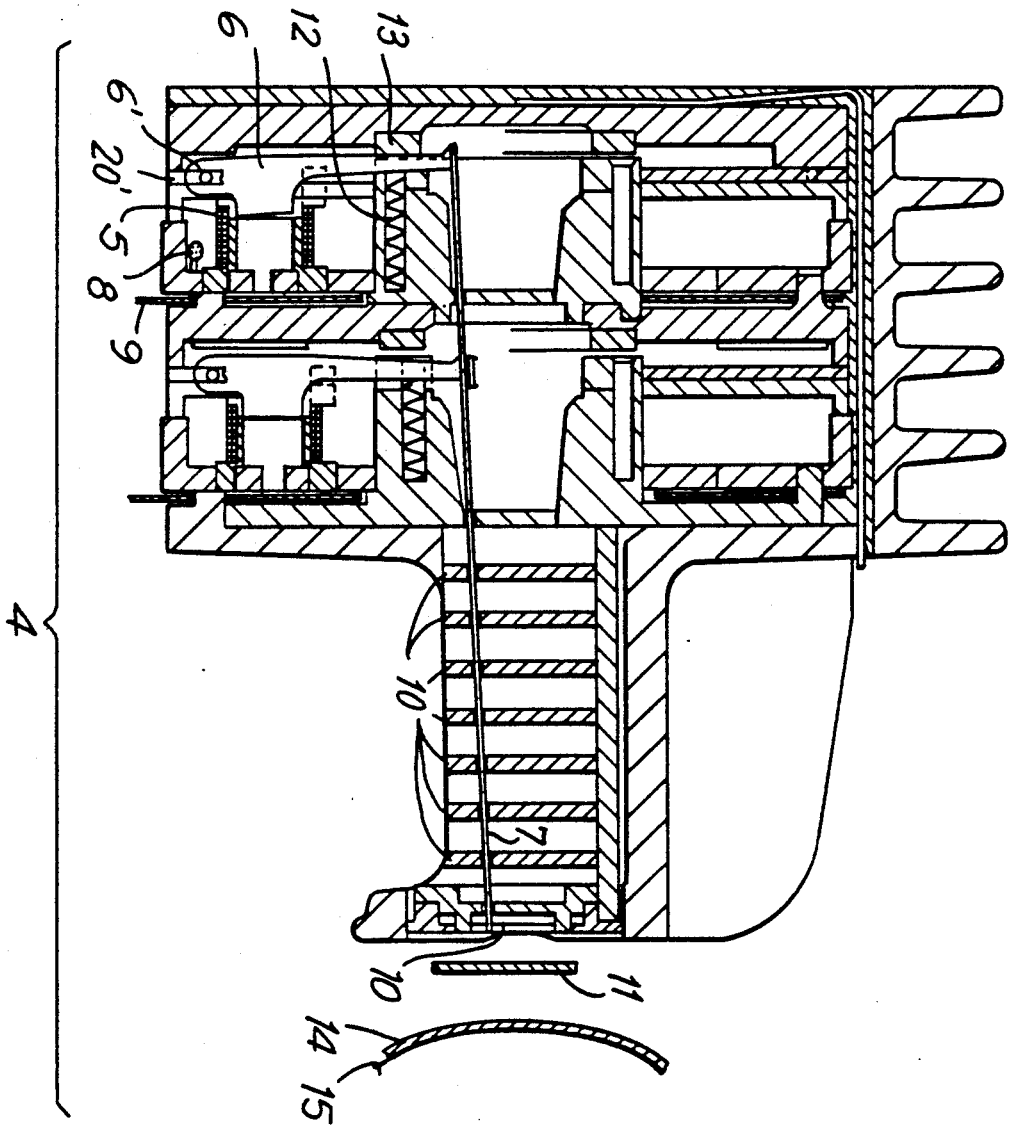
FIG. 2 is a cross-sectional side view of an embodiment of an impact print head, well suited for inclusion in the printer of FIG. 1.

Functional elements of a printer 100, formed in accordance with a first embodiment of the invention are shown in block diagram form in FIG. 1. A print head 4, shown in cross-sectional view in FIG. 2 is an example of an impact print head that is well suited for inclusion in printer 100. Print head 4 includes a frame 20' and a driving lever 6, pivotally mounted to frame 20' about a pivot point 6'. A distal end of driving lever 6 is rigidly secured to a printing wire 7. Printing wire 7 acts as the impact printing member for print head 4.

Print head 4 also includes a driving coil 5 as a driving mechanism for selectively moving lever 6. Driving coil 5 is selectively energized in response to a signal from a driving controller 3 which receives a signal from a character generator 2. In response to a print signal, driving coil 5 will energize and magnetically attract driving lever 6 to cause driving lever 6 to pivot fully in a clockwise direction, as viewed in FIG. 2. Pivoting driving lever 6 fully in a clockwise direction causes printing wire 7 to travel in the direction of an arrow A and impact a transfer medium such as an ink ribbon 11 against a recording medium such as printing paper 14 which is releasably disposed on a platen 15, to transfer printing material thereon to generate printed characters and images.

Print head 4 further includes a damper 13 on frame 20' and a return spring 12, pressed against driving lever 6. After driving coil 5 is de-energized, return spring 12 presses driving lever 6 back against damper 13 and maintains lever 6 and thereby printing wire 7, in a home position. Driving coil 5 must be powerful enough, when energized, to overcome a return force exerted by spring 12.

Printing wire 7 is positioned by and travels through a plurality of wire guides 10. Wire guides 10 are constructed and arranged so that printing wire 7 moves from the home position toward the printing position, in contact with platen 15, with minimal frictional wear and interference. However, printing wire 7 can become temporarily lodged in wire guides 10 because ink from ink ribbon 11 can unintentionally become disposed between wire 7 and guides 10. Further, driving lever 6 can become unintentionally temporarily fixed in the home position against damper 13 because lubricant can improperly interfere with movement of lever 6. The ability of printing material and lubricant to interfere with movement of lever 6 and printing wire 7 increases considerably at temperatures below about 10° C. for many types of printing material and lubricants. Accordingly, at such low temperatures, printing errors can occur before the printer becomes warmed-up by movement of the printing elements.

To operate printer 100 to print characters and images, a printing signal that includes a preprinting signal followed by printing data is input. The preprinting signal activates a temperature detector 1 which measures the temperature of the printer such as by measuring the resistance of a thermistor 8 of print head 4 which is coupled to temperature detector 1 through a headboard 9 or by employing another appropriate type of temperature sensing device. It is preferable that the temperature detector measures the temperature of the print head portion of the printer. It is also noted that temperature detector 1 can be coupled to a carriage controller 16 which supports print head 4 to provide an appropriate signal to drive a carriage motor 17.

If the detected temperature is below a preselected temperature set point, temperature detector 1 outputs a warm-up signal to character generator 2 and driving controller 3. This set point is preferably 10° C., but can vary, depending on the types of printing material and lubricant employed in the print head of the printer. In response to the warm-up signal from temperature detector 1, driving controller 3 will output a warm-up signal to print head 4 and cause print head 4 to be operated in a manner to increase the temperature thereof and free the motive elements therein. However, the print head will be operated so that actual printing does not occur.

If the print head of printer 100 is constructed similar to print head 4, driving coil 5 will be partially energized to partially pivot lever 6. It is preferable to construct print head 4 so that energizing coil 5 with about 60% of the normal printing energy will cause wire 7 and lever 6 to move enough to heat print head 4 sufficiently and dislodge interfering material, but not enough so that the free end of wire 7 contacts printing ribbon 11. The warm-up oscillation of wire 7 can be repeated a plurality of times, such as about 10 pulses having a 150 μsec duration at 100 Hz.

By carrying out the warm-up operation in accordance with the present invention, driving lever 6 and printing wire 7 are activated, but operate within a limited range of motion in which printing does not occur. Accordingly, the ink, lubricant and other material between printing wire 7 and wire guides 10 and lubricant between driving lever 6 and damper 13 lower in viscosity or become sufficiently scattered so that they no longer interfere. This enables printing to be accurately performed in accordance with the given printing data, without omission of printed dots or irregularities in print darkness and tone.

If the temperature is above the set point, the character generator outputs a signal corresponding to the printing data and will cause the driving controller to cause the print head to print characters and images as desired in accordance with the printing signal such as by fully energizing coil 5. In addition to the clapper type print head described above, the warm-up operation is also advantageously performed in a printer having other types of print heads, such as spring charge type print heads.

Figure 3:
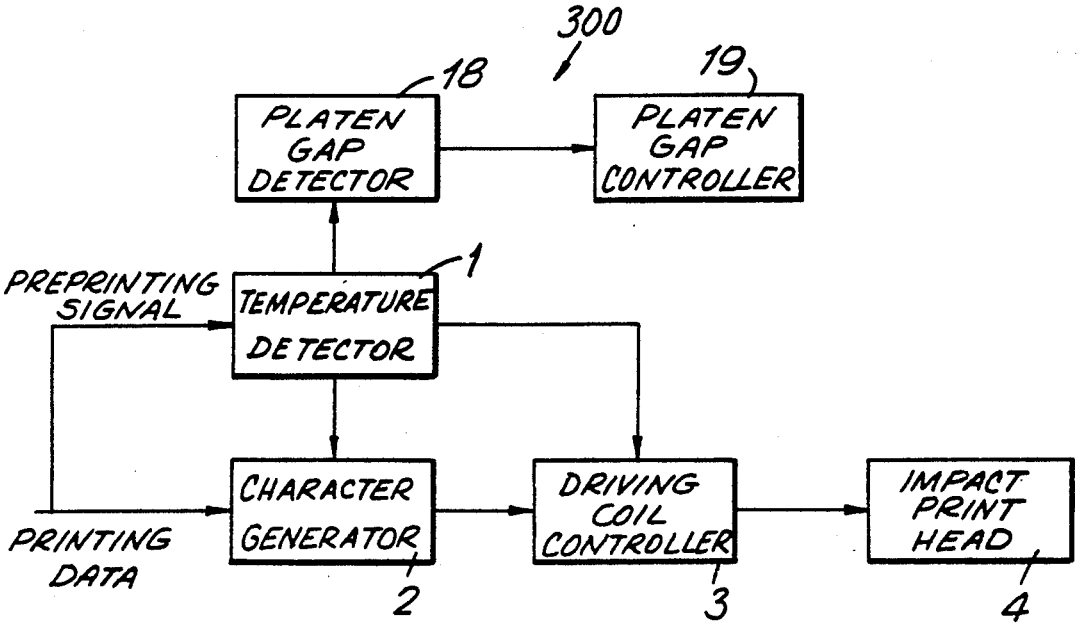
FIG. 3 is a block diagram showing functional portions of a printer constructed in accordance with a second embodiment of the present invention.
Figure 4:
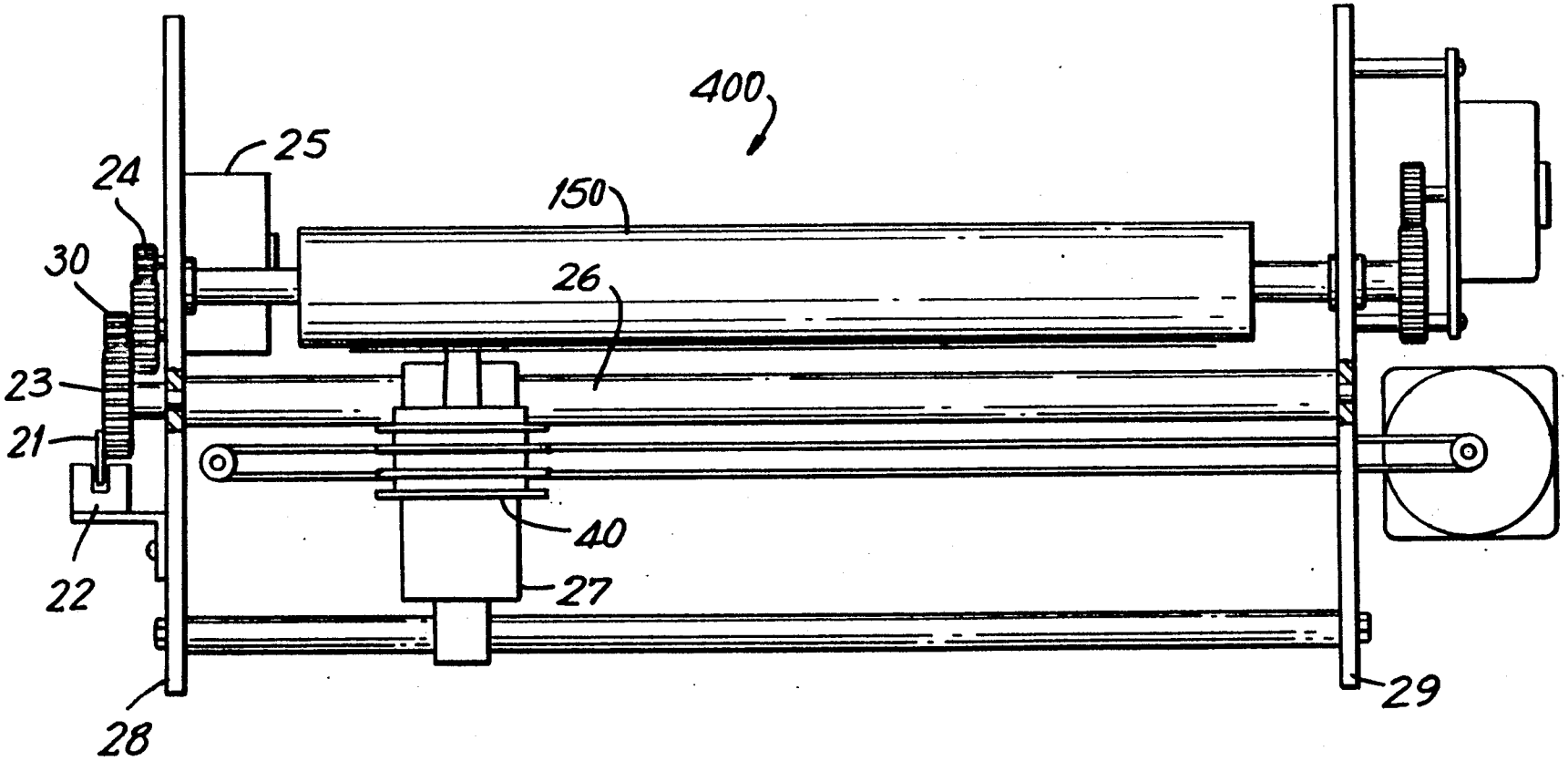
FIG. 4 is a top plan view of a printer constructed in accordance with the second embodiment of the present invention.

Functional elements of a printer 300, formed in accordance with a second embodiment of the present invention are shown in block diagram form in FIG. 3. Printer 300 is similar to printer 100 and further includes a platen gap detector 18 which inputs a signal to a platen gap controller 19 which widens the platen gap between the ends of the printing wires and the platen s that the printing paper will not become stained during the warm-up operation. Referring to FIG. 4, a printer 400 is shown in plan view. Printer 400 is an example of a printer that is well suited to embody the functional elements of printer 300.

Printer 400 includes a carriage 27 having an impact print head 40 mounted thereon. Print head 40 can be constructed similar to print head 4 of FIG. 2. Carriage 27 is slidably mounted on an eccentric carriage guide shaft 26 and is movable in a direction parallel with the axis of a platen 150 of printer 400. Eccentric carriage guide shaft 26 is supported at both ends by throughholes which are provided in a side frame 28 and a frame side 29 of printer 400 in such a manner that guide shaft 26 can rotate forward or backward, but cannot move in any other manner.

To vary the width of the platen gap between a print condition and a warm-up condition in which the separation is too great for printing to occur, printer 400 is provided with a platen gap adjusting gear 23, rigidly secured to the left-hand end of eccentric carriage guide shaft 26. Platen gap gear 23 is rotated by a motor 25 mounted on frame side 28 which rotates a driving gear 24, engaged with a transmission gear 30 which is engaged with platen gap adjusting gear 23. Thus, when motor 25 rotates forward or backward, eccentric carriage guide shaft 26 rotates forward or backward and carriage 27 thereby moves forward or backward and the platen gap increases or decreases as a result of the eccentric shape of eccentric carriage guide shaft 26.

To correctly set the width of the platen gap, printer 400 includes a reference position detecting member 21, rigidly secured to one side of platen gap adjusting gear 23. A photosensor 22 that includes both a light-emitting element and a light-receiving element is mounted on an outer side of side frame 28. Photosensor 22 detects the position of detecting member 21 to set the home position of the platen gap. Other available mechanisms which will correctly space the ends of the printing members from the platen in response to a signal from the temperature detector may be substituted.

Temperature detector 1 receives a pre-printing signal located at the beginning of the printing data signal and initiates temperature detection. If the detected temperature of the print head is not higher than the set-point temperature, a warm-up signal is sent from temperature detector 1 to character generator 2 and driving coil controller 3. At the same time, temperature detector 1 sends a warm-up signal to platen gap detector 18 which sends a signal to platen gap controller 19. When this occurs in printer 400, motor 25 rotates platen gap adjusting gear 23, thereby positioning eccentric carriage guide shaft 26 at the home position. In this condition, the platen gap reaches a maximum width and warming-up by operating the impacting members of print head 40 is conducted.

After the warm-up is completed, a print position signal is output to return carriage 27 to a print position. The distance through which carriage 27 should move toward platen 15 is output in the form of a signal representing an angle of rotation of motor 25. Motor 25 rotates eccentric carriage guide shaft 26 to set a predetermined platen gap and then printing occurs in accordance with the printing data.

The platen gap is widened to a maximum during the warm-up. Even if the energy driving the impact members, such as printing wires, during warming-up is increased to fully extend the impact members, printing paper will not be stained. It is thereby possible to lower the viscosities of the ink, the lubricant or scatter the ink and lubricant or other interfering material effectively, within a short period of time and thereby obtain printing that is free of missing dots and darkness irregularities.

Accordingly, impact printers constructed in accordance with the invention eliminate deficiencies of prior art impact printers by providing an effective warm-up operation, controlled by the temperature of the printer and preferably the temperature of the print head. Impact printers constructed in accordance with the invention can produce excellent print quality without omitted printed portions or ink stains caused by an inadequate warm-up procedure.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer that prints by impacting a transfer medium in response to a print signal to transfer printing material from the transfer medium to a recording medium, comprising:

signal means for providing a print signal having a preprinting signal portion followed by a data signal portion;

impact means including at least one impact member for impacting the transfer medium;

temperature detecting means for measuring the temperature of the printer, comparing the temperature to a selected value and providing a warm-up signal if the temperature is less than or equal to the selected value, the temperature detecting means being responsive to the preprinting signal;

impact driving means responsive to the warm-up signal and the data signal for displacing the impact member in response to said data signal between a first home position away from the transfer medium and a second printing position in contact with the transfer medium and between the first home position and a third warm-up position in response to said warm-up signal, not contacting the transfer medium; and positioning means responsive to the data and warm-up signals for positioning the impact member close enough to contact the transfer medium in response to the data signal and widening the distance between the impact member in the first home position and the transfer medium so that the impact member is far enough away from the transfer medium so that it does not contact the transfer medium in response to the warm-up signal.

2. The printer of claim 1, wherein the impact member is a printing wire that moves axially from the home position to the printing position and one end of the printing wire impacts the transfer medium when in the printing position.

3. The printer of claim 1, wherein the temperature detecting means includes a thermistor.

4. The printer of claim 1, wherein the impact driving means includes at least one driving coil.

5. The printer of claim 2, wherein the impact driving means includes at least one driving coil.

6. The printer of claim 1, wherein the selected temperature is about 10° C.

7. The printer of claim 5, further comprising a lever pivotally mounted on the printer, said printing wire being operatively coupled to said lever so that the lever pivots toward the driving coil when the driving coil is energized and displaces the printing wire toward the printing position.

8. The printer of claim 1, wherein the positioning means includes an eccentric shaft constructed and arranged so that rotating the eccentric shaft in response to the data and warm-up signals causes the distance between the impact member in the first home position and the transfer medium to selectively vary between the closer and wider distances.

9. The printer of claim 1, wherein the temperature detecting means measures the temperature of the impact means.

10. A printer that prints in response to print signals by impacting a transfer medium to cause printing material to transfer from the transfer medium to a recording medium, comprising:

a platen for releasably securing the recording medium;

signal means for providing a print signal;

temperature detection means for measuring the temperature of the printer, comparing the temperature to a set point and outputting a warm-up signal if the temperature is not higher than the set point;

impact means including impact members responsive to the print signal and warm-up signal for causing the impact members to travel a selected distance from a first home position to a second impact position closer to the platen in response to the print signal and traveling toward and then away from the platen in response to the warm-up signal;

a carriage movably supporting the impact means; and carriage positioning means responsive to the warm-up signal for widening the distance between the transfer medium and the carriage so that when the impact member travels as far as about the selected distance, it does not contact the transfer medium in response to the warm-up signal and when there is no warm-up signal, positioning the carriage closer to the transfer medium so that the impact member will impact the transfer medium in response to the print signal.

11. The printer of claim 10, wherein the impact member is a printing wire having a free end that impacts the transfer medium during printing.

12. The printer of claim 10, wherein the impact means causes the impact member to travel a distance shorter than the selected distance in response to the warm-up signal.

13. The printer of claim 10, wherein the set point is about 10° C.

14. A method of warming-up an impact printer having a platen and a print head that includes at least one impact member, comprising:

providing a print signal having a preprinting signal portion followed by a data signal portion;

measuring the temperature of the printer in response to the preprinting signal;

comparing the temperature to a set point;

providing a warm-up signal if the temperature is not higher than the set-point; and operating the printer in response to the warm-up signal so that the impact member of the print head moves for a selected period and printing of characters or images does not occur and then the printhead prints in response to the data signal to print characters or images.

15. The method of claim 14, wherein it is the temperature of the print head that is compared with the set-point.

16. The method of claim 14, including moving the platen and print head apart in response to the warm-up signal and then returning the print head and platen to the original positions prior to the output of the data signal.

17. The method of claim 14, wherein the printer includes a printing wire operably coupled to a driving coil and the printer is operated by energizing the coil.

18. The method of claim 14, wherein the printing means oscillates the printing member about 10 times at about 100 Hz in response to the warm-up signal.

19. A method of warming-up an impact printer having a platen and a print head that includes at least one impact member, comprising:

measuring the temperature of the printer;

comparing the temperature to a set point;

providing a warm-up signal if the temperature is not higher than the set-point;

moving the platen and print head apart, from an original position, in response to the warm-up signal;

operating the printer in response to the warm-up signal so that the impact member of the print head moves for a selected period but printing of characters or images does not occur; and returning the print head and platen to the original position at the end of the warm-up signal.

20. The method of claim 19, wherein the impact member is oscillated about 10 times at about 100 Hz to the warm-up signal.

* * * * *